US010053789B2

(12) United States Patent
Foelicher et al.

(10) Patent No.: US 10,053,789 B2
(45) Date of Patent: Aug. 21, 2018

(54) METHOD OF OBTAINING A 18 CARACTS 3N GOLD ALLOY

(75) Inventors: Thomas Foelicher, Le Landeron (CH); Christophe Henzirohs, Sonceboz (CH); Guido Plankert, Boppelsen (CH)

(73) Assignee: The Swatch Group Research and Development Ltd, Marin (CH)

( * ) Notice: Subject to any disclaimer, the term of this patent is extended or adjusted under 35 U.S.C. 154(b) by 1776 days.

(21) Appl. No.: 13/427,558

(22) Filed: Mar. 22, 2012

(65) Prior Publication Data

US 2012/0247968 A1 Oct. 4, 2012

(30) Foreign Application Priority Data

Mar. 31, 2011 (EP) ..... 11160669

(51) Int. Cl.
*C25D 3/58* (2006.01)
*C25D 3/62* (2006.01)

(52) U.S. Cl.
CPC ..... *C25D 3/62* (2013.01)

(58) Field of Classification Search
CPC ..... C25D 3/58
USPC ..... 205/240, 242, 247, 249
See application file for complete search history.

(56) References Cited

U.S. PATENT DOCUMENTS

| | | | | |
|---|---|---|---|---|
| 3,642,589 | A * | 2/1972 | Nobel et al. | 205/242 |
| 4,980,035 | A * | 12/1990 | Emmenegger | 205/238 |
| 2005/0184369 | A1* | 8/2005 | Sonoda et al. | 257/677 |
| 2006/0283714 | A1* | 12/2006 | Egli et al. | 205/242 |

FOREIGN PATENT DOCUMENTS

| | | | |
|---|---|---|---|
| EP | 0 416 342 | A1 | 3/1991 |
| EP | 0 566 054 | A1 | 10/1993 |
| EP | 1 728 898 | A2 | 12/2006 |
| EP | 2 312 021 | A1 | 4/2011 |
| JP | 62-164890 | A | 7/1987 |

OTHER PUBLICATIONS

European Search Report of EP 11 16 0669, dated May 26, 2011.

* cited by examiner

*Primary Examiner* — Edna Wong
(74) *Attorney, Agent, or Firm* — Sughrue Mion, PLLC

(57) ABSTRACT

A method for the galvanoplastic deposition of a gold alloy on an electrode dipped into a bath including gold metal, organometallic compounds, a wetting agent, a sequestering agent and free cyanide, the alloy metals being copper metal and silver metal allowing a mirror-bright yellow gold alloy to be deposited on the electrode characterized in that the bath respects a proportion of 21.53% gold, 78.31% copper and 0.16% silver.

13 Claims, No Drawings

METHOD OF OBTAINING A 18 CARACTS 3N GOLD ALLOY

This application claims priority from European Patent Application No. 11160669.5 filed Mar. 31, 2011, the entire disclosure of which is incorporated herein by reference.

FIELD OF THE INVENTION

The invention relates to electrolytic deposition in the form of a thick gold alloy layer and the method of fabricating the same.

BACKGROUND OF THE INVENTION

In the field of decorative plating, methods are known for producing yellow coloured, electrolytic depositions of gold, with a grade equal to or more than 9 carats, which is ductile, with a thickness of 10 microns and with a high level of tarnish resistance. These depositions are obtained by electrolysis in an alkaline galvanic bath containing 0.1 to 3 $g \cdot l^{-1}$ cadmium, in addition to gold and copper.

The depositions obtained by these known methods have, however, a cadmium content of between 1 and 10%. Cadmium facilitates deposition of thick layers, i.e. between 1 and 800 microns and provides a yellow coloured alloy while reducing the quantity of copper contained in the alloy. However, cadmium is extremely toxic and prohibited in some countries.

18 carats gold alloys without any cadmium, which contain copper and zinc, are also known. However, these depositions have an excessively pink hue (too rich in copper). Finally, these depositions have poor corrosion resistance which means they tarnish quickly.

SUMMARY OF THE INVENTION

It is an object of the present invention to overcome all or part of the aforementioned drawbacks, by providing a manufacturing method for depositing a thick, 3N yellow coloured, 18 carats gold alloy layer which has neither zinc nor cadmium as its main constituents.

The invention therefore relates to a method for the galvanoplastic deposition of a gold alloy on an electrode dipped into a bath including gold metal, organometallic compounds, a wetting agent, a sequestering agent and free cyanide, the alloy metals being copper metal and silver metal allowing a mirror-bright yellow gold alloy to be deposited on the electrode characterized in that the bath respects a proportion of 21.53% gold, 78.31% copper and 0.16% silver.

Thus, surprisingly, the bath even based on high copper concentration is able, advantageously according to the invention, to achieve a 3N yellow gold alloy in respecting a proportion of 21.53% gold, 78.31% copper and 0.16% silver and a 5N red gold alloy.

According to other advantageous features of the invention:

- the bath includes from 1 to 10 $g \cdot l^{-1}$ of gold metal in double gold and potassium cyanide form;
- the bath includes from 10 to 60 $g \cdot l^{-1}$ of copper metal in copper iodide form;
- the bath includes from 10 $mg \cdot l^{-1}$ to 1 $g \cdot l^{-1}$ of silver metal in double silver and potassium cyanide form;
- the bath includes from 3 to 35 $g \cdot l^{-1}$ of cyanide;
- the wetting agent has a concentration of between 0.05 and 10 $ml \cdot l^{-1}$

- the wetting agent is chosen from among polyoxyalkenic, ether phosphate, lauryl sulphate, dimethyldodecylamine-N-oxide, dimethyl(dodecyl) ammonium propane sulfonate;
- the bath includes a concentration of amine of between 0.01 and 5 $ml \cdot l^{-1}$;
- the bath includes a concentration of depolariser of between 0.1 and 20 $mg \cdot l^{-1}$;
- the bath includes phosphate, carbonate, citrate, sulphate, tartrate, gluconate and/or phosphonate type conductive salts;
- the temperature of the bath is kept between 50 and 90° C.;
- the of the bath is kept between 8 and 12;
- the method is performed at a current density of between 0.05 to 1.5 $A \cdot dm^{-2}$;

The invention also concerns an electrolytic deposition in the form of a gold alloy obtained from a method according to any of the preceding claims, the thickness of which is between 1 and 800 microns and which includes copper, characterized in that it includes silver as the third main compound and in that the deposition is made of 75% gold, 19% copper and 6% silver, allowing a bright 3N colour to be obtained.

DETAILED DESCRIPTION OF THE PREFERRED EMBODIMENTS

The invention concerns an electrolytic deposition of a gold alloy with a 3N colour which, surprisingly, includes Au—Cu—Ag as its respective main compounds in proportions that are not known, to obtain the 3N colour, i.e. bright yellow.

In the example deposition above, there is a gold alloy, free of toxic metals or metalloids, and in particular free of cadmium and zinc, with a 3N yellow colour, a thickness of 200 microns, excellent brightness and with a very high level of resistance to wear and tarnishing.

This deposition is obtained by electrolysis in an electrolytic bath of the type:

Au: 5.5 $g \cdot l^{-1}$;
Cu: 20 $g \cdot l^{-1}$;
Ag: 40 $mg \cdot l^{-1}$;
CN: 5 $g \cdot l^{-1}$;
pH: 10.5;
Temperature: 80° C.;
Current density: 0.3 $A \cdot dm^{-2}$;
Wetting agent: 0.05 $ml \cdot l^{-1}$ NN-Dimethyldodecyl N-oxide;
Iminodiacetic: 20 $g \cdot l^{-1}$;
Ethylenediamene: 0.5 $ml \cdot l^{-1}$;
Gallium, selenium or tellurium: 10 $mg \cdot l^{-1}$.

Consequently, the bath respects a proportion of 21.53% gold, 78.31% copper and 0.16% silver between its main compounds.

The electrolysis is preferably followed by a heat treatment at a temperature of between 200 and 450 degrees Celsius for 1 to 30 minutes in order to obtain a deposition of optimum quality.

These conditions provide a cathodic yield of 95 $mg \cdot A \cdot min^{-1}$ with a deposition speed of around 10 μm per hour in the case of the example.

Thus, surprisingly, the bath according to the invention provides a deposition in proportions of around 75% gold, 19% copper and 6% silver, corresponding to a 3N colour, 18 carat deposition, very different proportions from the usual electrolytic depositions for this colour, which tend to be depositions of around 75% gold, 12.5% copper and 12.5% silver.

The bath may also contain a brightener. This is preferably a butynediol derivative, a pyridinio-propanesulfonate or a mixture of the two, a tin salt, sulfonated castor oil, methylimidozole, dithiocarboxylic acid such as thiocarbamide, thiobarbituric acid, imidazolidinthion or thiomalic acid.

In these examples, the electrolytic bath is contained in a polypropylene or PVC bath holder with a heat insulating coating. The bath is heated using quartz, PTFE, porcelain or stabilised stainless steel thermo-plungers. Good cathodic rod movement and electrolyte flow must be maintained. The anodes are made of platinum plated titanium, stainless steel, ruthenium, iridium or alloys of the latter two.

Of course, the present invention is not limited to the illustrated example but is capable of various variants and alterations which will be clear to those skilled in the art. In particular, the bath may contain the following metals: Zr, Se, Te, Sb, Sn, Ga, As, Sr, Be, Bi in negligible quantities.

Moreover, the wetting agent may be of any type that can wet in an alkaline cyanide medium.

What is claimed is:

1. A method for the galvanoplastic deposition of a 3N yellow gold alloy on an electrode, the method comprising:

(a) providing an electrode;

(b) dipping the electrode into a bath, wherein the bath includes gold metal, copper metal, silver metal, organometallic compounds, a wetting agent, a sequestering agent and free cyanide; and (c) galvanoplastically depositing a 3N yellow gold alloy on the electrode, wherein the bath has a proportion of 21.53% gold, 78.31% copper and 0.16% silver, wherein the deposited 3N yellow gold alloy is made of 75% gold, 19% copper and 6% silver.

2. The method according to claim 1, wherein the bath includes from 1 to 10 $g \cdot l^{-1}$ of gold metal in double gold and potassium cyanide form.

3. The method according to claim 1, wherein the bath includes from 10 to 60 $g \cdot l^{-1}$ of copper metal in copper iodide form.

4. The method according to claim 1, wherein the bath includes from 10 $mg \cdot l^{-1}$ to 1 $g \cdot l^{-1}$ of silver metal in double silver and potassium cyanide form.

5. The method according to claim 1, wherein the bath includes from 3 to 35 $g \cdot l^{-1}$ of free cyanide.

6. The method according to claim 1, wherein the wetting agent includes a concentration of between 0.05 and 10 $ml \cdot l^{-1}$.

7. The method according to claim 1, wherein the wetting agent is selected from the group consisting of poly-oxyalkenic, ether phosphate, lauryl sulphate, dimethyldodecylamine-N-oxide and dimethyl(dodecyl) ammonium propane sulfonate.

8. The method according to claim 1, wherein the bath further includes a concentration of an amine of between 0.01 and 5 $ml \cdot l^{-1}$.

9. The method according to claim 1, wherein the bath further includes a concentration of a depolariser of between 0.1 to 20 $mg \cdot l^{-1}$.

10. The method according to claim 1, wherein the bath further includes phosphate, carbonate, citrate, sulphate, tartrate, gluconate and/or phosphonate conductive salts.

11. The method according to claim 1, wherein the temperature of the bath is kept between 50 and 90° C.

12. The method according to claim 1, wherein the pH of the bath is kept between 8 and 12.

13. The method according to claim 1, wherein the method is performed at a current density of between 0.05 to 1.5 $A \cdot dm^{-2}$.

* * * * *